US006651260B1

(12) United States Patent
Dodson

(10) Patent No.: US 6,651,260 B1
(45) Date of Patent: Nov. 25, 2003

(54) TOILET TANK TOP WITH EASY ACCESS TO DROP IN DEODORIZING DISCS

(76) Inventor: Vernon Dodson, 1400 W. Coronado Ave., Ridgecrest, CA (US) 93555

( * ) Notice: Subject to any disclaimer, the term of this patent is extended or adjusted under 35 U.S.C. 154(b) by 0 days.

(21) Appl. No.: 10/145,776

(22) Filed: May 15, 2002

(51) Int. Cl.[7] ..... E03D 9/02

(52) U.S. Cl. ..... 4/227.1; 4/227.4; 4/227.5; 4/353; 4/294

(58) Field of Search ..... 4/222, 222.1, 223–224, 4/225.1, 227.1, 227.2, 227.4, 227.5, 231, 294, 353

(56) References Cited

U.S. PATENT DOCUMENTS

| | | | | | |
|---|---|---|---|---|---|
| 939,424 | A | * | 11/1909 | Kneen | 4/227.1 |
| 1,062,148 | A | * | 5/1913 | Fraser | 4/355 |
| 1,134,556 | A | * | 4/1915 | Recker | 4/222 |
| 1,419,498 | A | * | 6/1922 | Grant | 4/232 |
| 1,950,139 | A | * | 3/1934 | French | 4/227.1 |
| 2,207,363 | A | * | 7/1940 | Vipond | 4/227.3 |
| 2,591,817 | A | * | 4/1952 | Huff | 4/228.1 |
| 3,023,427 | A | | 3/1962 | Behringer | |
| 3,290,698 | A | * | 12/1966 | Joyner et al. | 4/225.1 |
| 3,588,926 | A | * | 6/1971 | Buck, Jr. | 4/231 |
| 3,864,763 | A | * | 2/1975 | Spransy | 4/227.5 |
| 4,416,854 | A | * | 11/1983 | Nielsen | 210/748 |
| 4,516,281 | A | * | 5/1985 | MacPherson et al. | 4/319 |
| 4,668,475 | A | * | 5/1987 | Meloy | 422/37 |
| 4,817,214 | A | * | 4/1989 | Stuessy | 4/222 |
| 5,593,648 | A | * | 1/1997 | Christie et al. | 422/266 |
| 5,699,562 | A | * | 12/1997 | Lu | 4/223 |
| 5,727,262 | A | * | 3/1998 | Littlejohn | 4/213 |
| 5,774,903 | A | * | 7/1998 | Wilson et al. | 4/227.1 |
| 5,881,396 | A | | 3/1999 | Rivera | |
| 5,903,930 | A | * | 5/1999 | Huang | 4/227.4 |
| 6,061,844 | A | * | 5/2000 | Barton | 4/341 |
| 6,339,850 | B1 | * | 1/2002 | Gore | 4/227.2 |

* cited by examiner

*Primary Examiner*—Timothy L. Maust
*Assistant Examiner*—Amanda Flynn

(57) ABSTRACT

A toilet tank top with easy access to drop in deodorizing discs for effectively deodorizing and disinfecting a toilet bowl. The toilet tank top with easy access to drop in deodorizing discs includes a main lid portion designed for abutting a top edge of a toilet tank. The main lid portion has an aperture that extends therethrough. The aperture is for receiving a tank cleansing tablet. A cover member is couplable to the main lid portion. The cover member is for selectively closing the aperture such that the tank cleansing tablet is insertable into the toilet tank without removal of the main lid portion.

8 Claims, 3 Drawing Sheets

TOILET TANK TOP WITH EASY ACCESS TO DROP IN DEODORIZING DISCS

BACKGROUND OF THE INVENTION

1. Field of the Invention

The present invention relates to sterilizing devices for toilet bowls and more particularly pertains to a new toilet tank top with easy access to drop in deodorizing discs for effectively deodorizing and disinfecting a toilet bowl.

2. Description of the Prior Art

The use of sterilizing devices for toilet bowls is known in the prior art. U.S. Pat. No. 5,881,396 describes a toilet cleaner assembly comprised of a reservoir capable of receiving a water soluble chemical cleaner capable of being filled when the toilet is refilled from a flush. Another type of sterilizing devices for toilet bowls is U.S. Pat. No. 4,416,854 describing a means for sterilizing a toilet bowl using a dispenser device that is attached to a toilet tank with a bracket. U.S. Pat. No. 3,023,427 describes a means for sterilizing a toilet bowl using a dispenser device that is attached to a toilet tank with a bracket.

While these devices fulfill their respective, particular objectives and requirements, the need remains for a device that includes a toilet tank cover with a sanitizing dispenser incorporated as described.

SUMMARY OF THE INVENTION

The present invention meets the needs presented above by utilizing an access door integrated with a toilet tank cover for facilitating inserting of a deodorizing disk through the aperture and into a mesh assembly.

Still yet another object of the present invention is to provide a new toilet tank top with easy access to drop in deodorizing discs that allows the user to quickly and easily deodorize and disinfect a toilet bowl.

Even still another object of the present invention is to provide a new toilet tank top with easy access to drop in deodorizing discs that eliminates the possible breakage of the toilet tank lid during removal of the lid from the toilet tank to insert a deodorizing disk.

To this end, the present invention generally comprises a main lid portion designed for abutting a top edge of a toilet tank. The main lid portion has an aperture that extends therethrough. The aperture is for receiving a tank cleansing tablet. A cover member is couplable to the main lid portion. The cover member is for selectively closing the aperture such that the tank cleansing tablet is insertable into the toilet tank without removal of the main lid portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
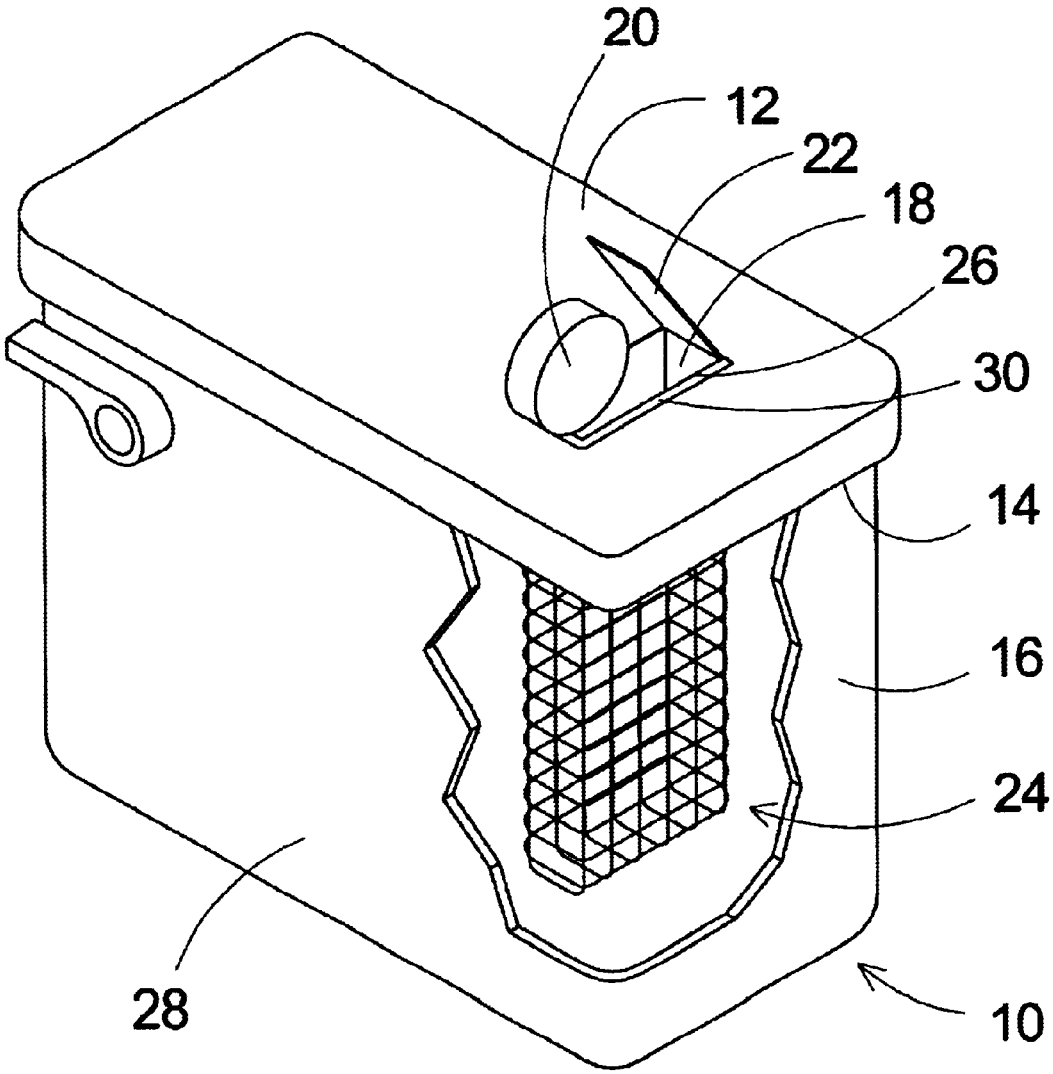
FIG. 1 is a perspective view of a new toilet tank top with easy access to drop in deodorizing discs according to the present invention.
Figure 2:
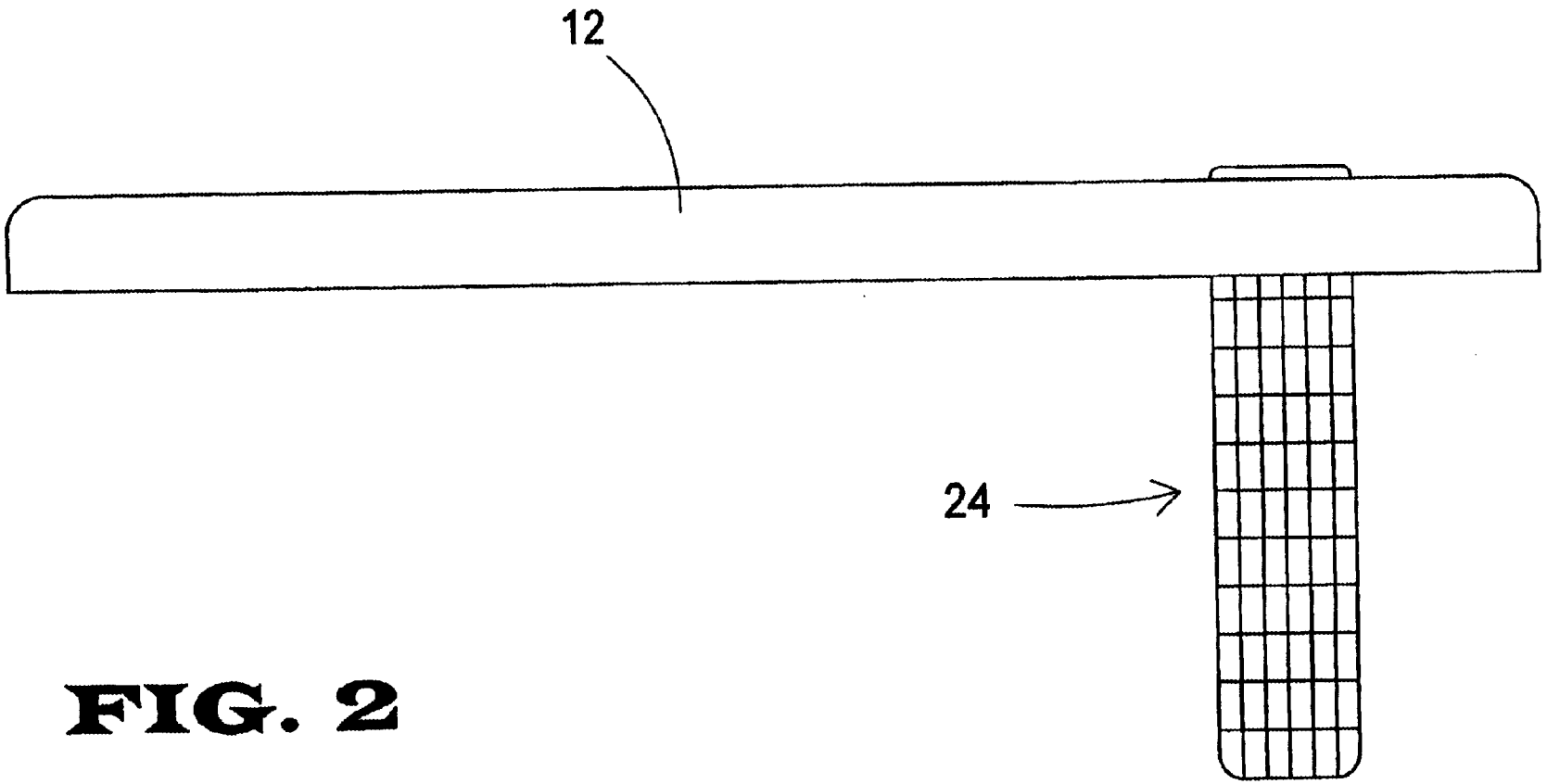
FIG. 2 is a front view of the present invention.
Figure 3:
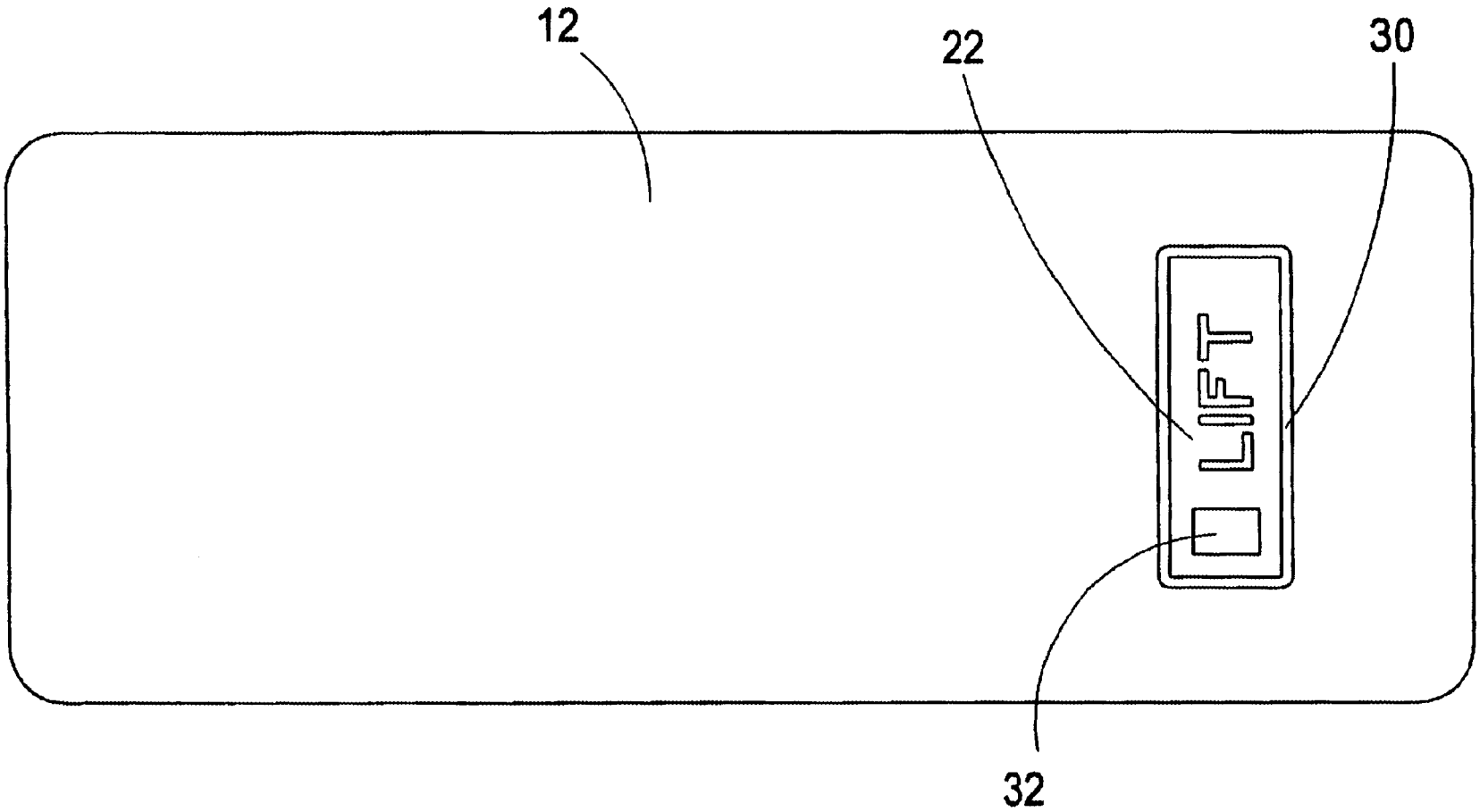
FIG. 3 is a top view of the present invention.

With reference now to the drawings, and in particular to FIGS. 1 through 3 thereof, a new toilet tank top with easy access to drop in deodorizing discs embodying the principles and concepts of the present invention and generally designated by the reference numeral 10 will be described.

As best illustrated in FIGS. 1 through 3, the toilet tank top with easy access to drop in deodorizing discs 10 generally comprises a main lid portion 12 designed for abutting a top edge 14 of a toilet tank 16. The main lid portion 12 has an aperture 18 that extends therethrough. The aperture 18 is for receiving a tank cleansing tablet 20. A cover member 22 is couplable to the main lid portion 12. The cover member 22 is for selectively closing the aperture 18 such that the tank cleansing tablet 20 is insertable into the toilet tank 16 without removal of the main lid portion 12.

The cover member 22 is hingeably coupled to the main lid portion 12 such that the cover member 22 has a closed position and an open position. The closed positioned is defined by the cover member 22 covering the aperture 18. The open position is defined as the aperture 18 is substantially unobstructed by the cover member 22.

A mesh assembly 24 is operationally coupled to the main lid portion 12. The mesh assembly 24 is positioned around a perimeter edge 26 of the aperture 18. The mesh assembly 24 is for inhibiting the toilet cleansing tablet 20 from resting upon a bottom surface 28 of the toilet tank 16. Thereby preventing permanent discoloration of the bottom surface 28 of the toilet tank 16 by the tank cleansing tablet 20.

The cover member 22 further includes a lip portion 30 positioned around a perimeter edge 26 of the aperture 18. The lip portion 30 provides a mechanical interface between the cover member 22 and the main lid portion 12. A cover member 22 hingeably coupled to the lip portion 30. The cover member 22 is for substantially closing the aperture 18 when the cover member 22 is in a closed position. The cover member 22 is for facilitating access to an interior of the toilet tank 16 when the cover member 22 is in an open position. The cover member 22 further includes a tab portion 32 that is operationally coupled to the cover member 22. The tab portion 32 is designed to be grasped by a human hand. The tab portion 32 facilitates movement of the cover member 22 between an open position and a closed position.

The main lid portion 12 has a width of, approximately 8½ inches, and a length of approximately 21½ inches. The cover member 22 further includes a lip portion 30 positioned around a perimeter edge 26 of the aperture 18. The lip portion 30 provides a mechanical interface between the cover member 22 and the main lid portion 12. A cover member 22 is hingeably coupled to the lip portion 30. The cover member 22 is for substantially closing the aperture 18 when the cover member 22 is in a closed position. The cover member 22 is for facilitating access to an interior of the toilet tank 16 when the cover member 22 is in an open position.

A tab portion 32 is operationally coupled to the cover member 22. The tab portion 32 is designed to be grasped by a human hand. The tab portion 32 facilitates movement of the cover member 22 between an open position and a closed position. The mesh assembly 24 has a width of approximately 1¾ inches, a height of approximately 8 inches, and a length of approximately 4¼ inches.

In use, a user would replace the standard toilet tank lid with the present invention. When the user wishes to insert a tank cleansing tablet the user would insert their finger into the tab portion of the cover member and lift. The user would then insert the cleansing tablet through the aperture and into the mesh assembly and close the cover member securing it to the lip portion.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lid assembly for use in conjunction with toilet tanks, comprising:

a main lid portion adapted for abutting a top edge of a toilet tank, said main lid portion having an aperture extending therethrough, said aperture being for receiving a tank cleansing tablet;

a cover member couplable to said main lid portion, said cover member being for selectively closing said aperture such that said tank cleansing tablet is insertable into the toilet tank without removal of said main lid portion;

a mesh assembly operationally coupled to said main lid portion, said mesh assembly being positioned around a perimeter edge of said aperture, said mesh assembly being for inhibiting the toilet cleansing tablet from resting upon a bottom surface of the toilet tank, thereby preventing permanent discoloration of the bottom surface of the toilet tank by the toilet cleansing tablet.

2. The assembly of claim 1 wherein said cover member being hingeably coupled to said main lid portion such that said cover member having a closed position and an open position, said closed positioned being defined by said cover member covering said aperture, said open position being defined as said aperture being substantially unobstructed by said cover member.

3. A lid assembly for use in conjunction with toilet tanks, comprising:

a main lid portion adapted for abutting a top edge of a toilet tank, said main lid portion having an aperture extending therethrough, said aperture being for receiving a tank cleansing tablet;

a cover member couplable to said main lid portion, said cover member being for selectively closing said aperture such that said tank cleansing tablet is insertable into the toilet tank without removal of said main lid portion;

wherein said cover member being hingeably coupled to said main lid portion such that said cover member having a closed position and an open position, said closed positioned being defined by said cover member covering said aperture, said open position being defined as said aperture being substantially unobstructed by said cover member; and a mesh assembly operationally coupled to said main lid portion, said mesh assembly being positioned around a perimeter edge of said aperture, said mesh assembly being for inhibiting the toilet cleansing tablet from resting upon a bottom surface of the toilet tank, thereby preventing permanent discoloration of the bottom surface of the toilet tank by the toilet cleansing tablet.

4. The assembly of claim 3, wherein said main lid portion having a width of approximately 8½ inches, said main lid portion having a length of approximately 21½ inches.

5. The assembly of claim 3, wherein said mesh assembly having a width of approximately 1¾ inches, said mesh assembly having a height of approximately 8 inches, said mesh assembly having a length of approximately 4¼ inches.

6. The assembly of claim 3, further comprising:

wherein said main lid portion having a width of approximately 8½ inches, said main lid portion having a length of approximately 21½ inches;

said cover member further comprises:

a lip portion positioned around a perimeter edge of said aperture, said lip portion providing a mechanical interface between said cover member and said main lid portion;

a cover member hingeably coupled to said lip portion, said cover member being for substantially closing said aperture when said cover member being in a closed position, said cover member being for facilitating access to an interior of the toilet tank when said cover member being in an open position;

a tab portion operationally coupled to said cover member, said tab portion adapted for being grasped by a human hand, said tab portion facilitating movement of said cover member between an open position and a closed position; and wherein said mesh assembly having a width of approximately 1¾ inches, said mesh assembly having a height of approximately 8 inches, said mesh assembly having a length of approximately 4¼ inches.

7. The assembly of claim 3, wherein said cover member further comprises:

a lip portion positioned around a perimeter edge of said aperture, said lip portion providing a mechanical interface between said cover member and said main lid portion;

a cover member hingeably coupled to said lip portion, said cover member being for substantially closing said aperture when said cover member being in a closed position, said cover member being for facilitating access to an interior of the toilet tank when said cover member being in an open position.

8. The assembly of claim 7, wherein said cover member further comprises a tab portion operationally coupled to said cover member, said tab portion adapted for being grasped by a human hand, said tab portion facilitating movement of said cover member between an open position and a closed position.

* * * * *